United States Patent [19]

Nonogaki et al.

[11] 4,353,224

[45] Oct. 12, 1982

[54] EVAPORATOR

[75] Inventors: Masayuki Nonogaki, Kariya; Katsuya Ishii, Anjo; Nobumasa Hirasawa, Chiryu, all of Japan

[73] Assignee: Nippondenso Co., Ltd., Kariya, Japan

[21] Appl. No.: 247,930

[22] Filed: Mar. 26, 1981

[30] Foreign Application Priority Data

Oct. 16, 1980 [JP] Japan ..... 55/148117[U]

[51] Int. Cl.[3] ..... F25B 39/02

[52] U.S. Cl. ..... 62/515; 62/285; 165/110; 165/111

[58] Field of Search ..... 62/272, 285, 515; 165/110, 111

[56] References Cited

U.S. PATENT DOCUMENTS

| | | | |
|---|---|---|---|
| 3,185,213 | 5/1965 | Wartenberg | 165/110 |
| 3,587,730 | 6/1971 | Milton | 165/110 |
| 3,678,993 | 7/1972 | Pierce | 62/285 |
| 3,750,418 | 8/1973 | Maudlin | 62/285 |
| 3,759,050 | 9/1973 | Slaasted et al. | 62/285 |
| 3,989,550 | 11/1976 | Newhard | 148/6.16 |
| 4,216,820 | 8/1980 | Andrew | 165/110 |

*Primary Examiner*—Ronald C. Capossela

*Attorney, Agent, or Firm*—Cushman, Darby & Cushman

[57] ABSTRACT

A refrigerant evaporator in a refrigerating cycle, especially in an automotive air conditioner of the type comprising a flat tube which is provided with refrigerant passages therein and formed to weave up and down, and a plurality of corrugated fin units each of which is interposed between the adjacent upright portions of the flat tube and fixed thereto so as to enhance heat exchange between refrigerant flowing within the flat tube and air flowing horizontally between the upright portions. In the evaporator of the above type, in order to prevent the water condensed over the surfaces of the flat tube and the corrugated fin units from being entrained by air into the compartment of the automobile, the portion of the flat tube on the downstream side of air flow is spaced apart from each corrugated fin unit to provide a non-contact space therebetween so as to force the condensed water to drop through the non-contact space.

4 Claims, 3 Drawing Figures

EVAPORATOR

BACKGROUND OF THE INVENTION

The present invention relates to in general an evaporator of the type comprising a flat tube and corrugated fins and more particularly the so-called corrugated fin type refrigerant evaporator adapted to be incorporated into a refrigerating cycle of an automotive air conditioner.

With the conventional automotive air conditioners, the condensed water produced over the surfaces of an evaporator has had a tendency of being easily entrained by the air passing around the evaporator and scattered into a passenger compartment. With an automotive air conditioner of the type in which a heating unit is connected to an air duct extending downstream of the evaporator, the condensed water has leaked through the joints of a heating unit case into a compartment. Especially in case of the so-called corrugated fin type evaporators the above-described drawbacks have been pronounced because it is difficult to drain the condensed water out of the evaporator due to its inherent construction.

SUMMARY OF THE INVENTION

The present invention was made to solve the above and other drawbacks encountered in the prior art corrugated fin type evaporators and has for its object to provide a corrugated fin type evaporator in which the water condensed over the surfaces of the evaporator is forced to drop or fall into a reservoir and consequently can be prevented from being entrained by the cooled air flow and scattered into passenger compartment.

Briefly stated, according to the present invention, there is provided a refrigerant evaporator in a refrigerating cycle of the type comprising a flat tube which is provided with a refrigerant passage or passages therein and formed to weave up and down to provide a plurality of upright portions to define horizontal passages of air to be cooled therebetween, and a plurality of corrugated fin units each of which is interposed between the adjacent upright portions of said flat tube in such a way that the folded or bent portions of said corrugated fin unit extend substantially horizontally and are in contact with the upright portions, wherein there is provided between said flat tube and each folded portion of said corrugated fin unit a non-contact space extending over a length of about 3 to 10 mm from the edge of said corrugated fin unit on the downstream side of air flow.

The above and other objects, effects and features of the present invention will become more apparent from the following description of a preferred embodiment thereof taken in conjunction with the accompanying drawings.

DESCRIPTION OF THE PREFERRED EMBODIMENT

Figure 1:
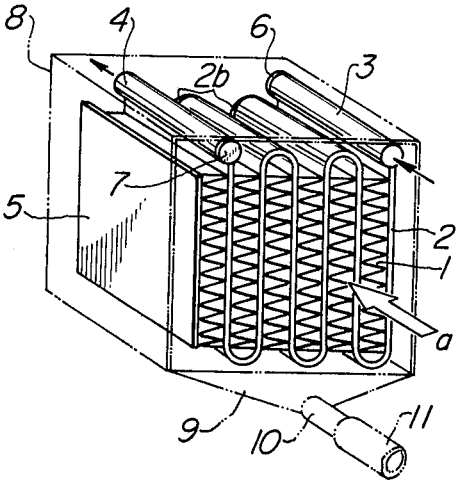
FIG. 1 is a perspective view of an evaporator in accordance with the present invention.
Figure 2:
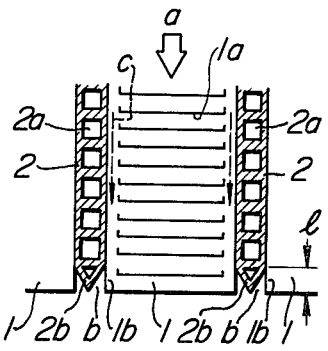
FIG. 2 is a fragmentary horizontal sectional view, on enlarged scale, showing the downstream edges of adjacent or opposed convolutions of the flat tube of the evaporator shown in FIG. 1.

Referring to FIGS. 1 and 2, reference numeral 1 designates a corrugated-fin unit; that is, a unit comprising a fin folded in the form of waves; and 2, a flat tube which is made of a metal such as aluminum having a high heat transfer rate and formed to weave up and down and which serves as a passageway for a refrigerant. As best shown in FIG. 2, the flat tube 2 is divided into a plurality of passages 2*a* in order to improve a heat transfer rate. One end of the flat tube 2 is brazed to an inlet pipe 3 while the other end thereof is brazed to an outlet pipe 4. The inlet pipe 3 is communicated with a decompression or expansion means (not shown) in a refrigerating cycle. The refrigerant flows from the inlet pipe 3 into the flat tube 2 and flows out of the outlet pipe 4 into a compressor (not shown). One ends of the inlet and output pipes 3 and 4 are closed with caps 6 and 7, respectively.

The corrugated fin units 2, which are made of aluminum, are interposed between the adjacent or opposed upright portions or convolutions of the flat tube 2 and securely joined thereto by brazing along their horizontal lines or strip areas of contact. Louvers 1*a* are disposed so that the air passing around an evaporator is disturbed and subsequently the heat exchange rate may be improved. A protective plate 5 is securely joined by brazing to the corrugated fin unit 1 which in turn is joined to the outermost upright portion of the flat tube 2.

The evaporator with the above-described construction is placed in a cooling casing 8 made of plastics and indicated by the imaginary lines in FIG. 1 and serves to cool air flowing in the direction indicated by the arrow a. The bottom of the casing 8 is so tapered as to serve as a reservoir 9 for receiving therein condensed water. An outlet 10 at the vertice of the tapered bottom or reservoir 9 is communicated with one end of a drain hose 11 extended out of an automotive body.

One edge 2*b* of the flat tube 2, which is located on the downstream side of air flow, is converged or tapered into the form of a triangle with a predetermined length l of for instance 5 mm and is therefore spaced apart from the corrugated fin units 1, leaving non-contact space b.

The evaporator formed in the above manner is subjected to a surface treatment so that the corrugated fin units 1 and the flat tube 2 may be provided with higher water wettability. More specifically, the evaporator is immersed for from two to four minutes in a treatment solution of chromate phosphate (at temperatures of about 60° C.) so that a first coating of chromate phosphate may be formed which exhibits high resistance to corrosion and high wettability. Thereafter the evaporator is again inserted from two to six minutes in a treatment solution of alkaline silicate whose major components are potassium pyrosphosphate and potassium silicate (the temperature of the solution being about 75° C.) so that a second coating of aluminum silicate may be formed which exhibits a higher degree of wettability. In the last step, the evaporator is dried by heating at 150° C. for about 30 minutes.

Next the mode of operation of the evaporator with the above-described construction will be described. When a refrigerating cycle is started, the refrigerant is decompressed, expanded and atomized by a decompressing or expansion means and flows into the inlet pipe 3 and the flat tube 2. When the refrigerant passes through the flat tube 2, heat exchange between the refrigerant and the air forced to flow around the evaporator by a fan (not shown) occurs through the outer walls of the flat tube 2 and the corrugated fin units 1. That is, the refrigerant is evaporated by absorbing the evaporation heat from the air and the evaporated refrigerant is returned through the outlet pipe 4 into the compressor (not shown). The cooled air then flows into the passenger compartment.

In this cooling cycle, the air is cooled to a low temperature of about 0° C. so that the water vapor contained in the air is condensed over the outer surface of the evaporator. The inventors observed the fact that the condensed water is collected especially at the points at which the flat tube 2 and the corrugated fin units 1 are made into contact with each other and then the collected condensed water is forced to flow downstream as indicated by the arrows C by the air a.

According to the present invention, however, non-contact space b is provided at the downstream edge of the flat tube 2 as described previously so that as the condensed water is forced to the non-contact space b, it drops and consequently is prevented from being entrained by the air flow a into the compartment.

Figure 3:
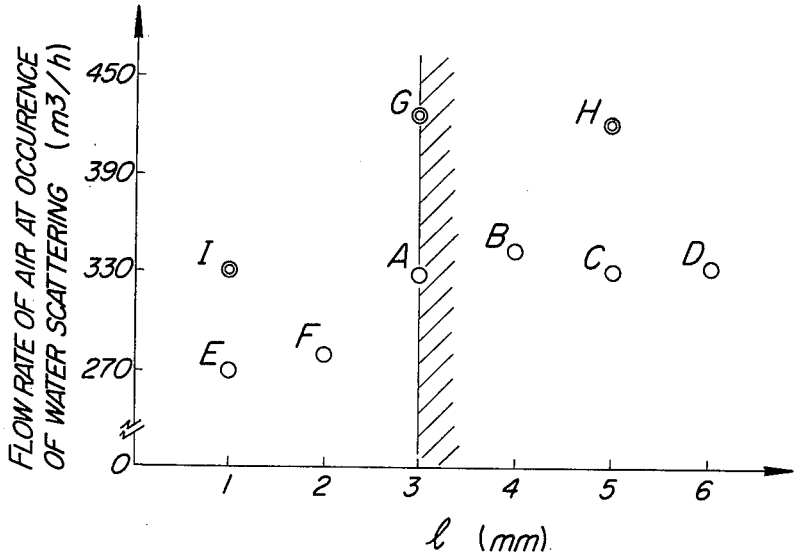
FIG. 3 is a graph used for the explanation of the effects attained by the present invention.

The inventors made extensive studies and experiments in an attempt for preventing the condensed water from being scattered into the compartment from the evaporator. The results of experiments are shown in FIG. 3. The length l of non-contact space b; that is, the length of the non-contact portion 1*b* of the corrugated fin unit 1 is plotted along the abscissa while the flow rate of the cooled air at which the condensed water is entrained by the cooled air and consequently scattered into the compartment is plotted along the ordinate. It is seen that when the length l of non-contact space b is longer than 3 mm, the flow rates A, B, C and D at which the condensed water is scattered are considerably higher than those E and F when the length l of non-contact space b is shorter than 3 mm. Thus it had been confirmed that the provision of non-contact space b is very effective in preventing the scattering of condensed water.

In the experiments conducted by the inventors, the length of non-contact space b was varied between 3, 4, 5 and 6 mm. As described previously, when the length l is longer than 3 mm, the scattering of condensed water can be considerably prevented. It is expected that the ability of preventing the scattering of condensed water will persist even when the length l is increased beyond 6 mm. However, when the length l is excessively increased, the efficiency of heat exchange will be inevitably reduced. As a result, a maximum length should be shorter than 10 mm in practice.

In FIG. 3 G and H show the flow rates at which the scattering of condensed water results when the evaporator is subjected to the surface treatments to form the first and second coatings as described previously. It is appreciated that the first and second coatings further improved the ability of preventing the scattering of condensed water. I shows the flow rate when the evaporator with non-contact space b of the length of 1 mm is subjected to the surface treatments to form the first and second coatings. It is observed that the formation of the first and second coatings only serves to prevent the scattering of condensed water. However, the provision of both the non-contact space b and the first and second coatings can considerably improve the ability of preventing the scattering of condensed water.

In summary, according to the present invention at the downstream edge of the flat tube 2, non-contact space of the length from 3 to 10 mm is provided between the flat tube 2 and the corrugated-fin units 1 so that the condensed water which is forced to flow downstream by the air flowing around the evaporator drops through the non-contact space b, whereby the condensed water can be prevented from being scattered into the compartment from the evaporator.

What is claimed is:

1. A refrigerant evaporator in a refrigerating cycle of the type comprising a flat tube which is provided with a refrigerant passage or passages therein and formed to weave up and down to provide a plurality of upright portions to define horizontal passages of air to be cooled therebetween, and a plurality of corrugated fin units each of which is interposed between the adjacent upright portions of said flat tube in such a way that the fold lines or portions of said corrugated fin unit extend substantially horizontally and are in contact with the upright portions, wherein there is provided between said flat tube and each fold line or portion of said corrugated fin unit a non-contact space extending upstream over a length of about 3 to 10 mm from the downstream edge of said corrugated fin unit relative to the direction of air flow.

2. A refrigerant evaporator as set forth in claim 1, wherein said flat tube and said corrugated fin units are coated with a first coating which exhibits a higher degree of resistance to corrosion and a second coating which exhibits a higher degree of wettability.

3. A refrigerant evaporator as set forth in claim 2, wherein said first coating consists of chromate phosphate and second coating consists of aluminum silicate.

4. A refrigerant evaporator as set forth in claim 1, 2 or 3, wherein said non-contact space is provided by tapering or converging the edge of said flat tube toward the downstream side of air flow to have a triangular cross sectional configuration.

* * * * *